US009091108B2

(12) United States Patent
Castello et al.

(10) Patent No.: US 9,091,108 B2
(45) Date of Patent: Jul. 28, 2015

(54) SENSING EDGE

(71) Applicant: Miller Edge, Inc., West Grove, PA (US)

(72) Inventors: Tim Castello, West Chester, PA (US); Krishnaraj Tejeswi, Exton, PA (US); Gary Leigh, Kennett Square, PA (US); Jack Provenzano, Hatfield, PA (US)

(73) Assignee: Miller Edge, Inc., West Grove, PA (US)

( * ) Notice: Subject to any disclaimer, the term of this patent is extended or adjusted under 35 U.S.C. 154(b) by 0 days.

(21) Appl. No.: 14/477,294

(22) Filed: Sep. 4, 2014

(65) Prior Publication Data

US 2014/0366649 A1 Dec. 18, 2014

Related U.S. Application Data

(62) Division of application No. 13/247,425, filed on Sep. 28, 2011, now Pat. No. 8,832,996.

(60) Provisional application No. 61/389,867, filed on Oct. 5, 2010.

(51) Int. Cl.
*E05F 15/02* (2006.01)
*E05F 15/10* (2006.01)
(Continued)

(52) U.S. Cl.
CPC ..... *E05F 15/006* (2013.01); *E05F 15/42* (2015.01); *E05F 15/44* (2015.01); *E05Y 2600/40* (2013.01); *E05Y 2800/12* (2013.01)

(58) Field of Classification Search
CPC ..... E05D 15/38; E05D 15/24; E05D 13/1215; E05F 15/0017; E05F 15/0026; E05F 15/006; E05F 15/1607; E05F 15/1661; E05F 15/42; E05F 15/44; E05Y 2201/434; E05Y 2201/232; E05Y 2600/40; E05Y 2800/12; B60J 10/08; B60J 10/0031; B60J 10/0042; B60J 10/0005; B60J 10/081
See application file for complete search history.

(56) References Cited

U.S. PATENT DOCUMENTS 3,133,167 A 5/1964 Miller
3,218,097 A * 11/1965 Bowers et al. ..... 403/295
(Continued)

FOREIGN PATENT DOCUMENTS

CA 1174902 A1 9/1984
DE 9414962 U1 11/1994
(Continued)

OTHER PUBLICATIONS

Underwriters Laboratories Inc., Standard for Safety, Door, Drapery, Gate, Louver, and Window Operators and Systems, UL325, Fifth Edition, Jun. 7, 2002.
(Continued)

*Primary Examiner* — Katherine Mitchell
*Assistant Examiner* — Shiref Mekhaeil
(74) *Attorney, Agent, or Firm* — Panitch Schwarze Belisario & Nadel LLP

(57) ABSTRACT

A sensing edge for providing a signal to a controller indicating that a forward edge of a door is obstructed during operation. The sensing edge includes an elongate sheath, a first end plug and a first end flap. The elongate sheath has a first end and a second end. A first cavity is located at the first end. The elongate sheath is mounted to the forward edge. The first end plug includes an inner end, an outer end, first engaging structures extending from the inner end and a first vertical groove in the outer end. The engaging structures are positioned within the first cavity in an assembled configuration. The first end flap includes a relatively flat first body and a first flange structure. The first flange structure is positioned in the first vertical groove in the assembled configuration to secure the first end flap to the first end plug.

4 Claims, 5 Drawing Sheets

(51) Int. Cl.

| | |
|---|---|
| ***E05F 15/00*** | (2015.01) |
| ***E05F 15/42*** | (2015.01) |
| ***E05F 15/44*** | (2015.01) |

(56) References Cited

U.S. PATENT DOCUMENTS

| | | | | | |
|---|---|---|---|---|---|
| 3,749,432 | A | * | 7/1973 | Janssen | 52/476 |
| 3,855,733 | A | | 12/1974 | Miller | |
| 3,872,642 | A | * | 3/1975 | Felix | 52/713 |
| 3,945,742 | A | * | 3/1976 | Condevaux | 403/255 |
| 4,021,129 | A | * | 5/1977 | Sykes | 403/252 |
| 4,045,927 | A | * | 9/1977 | Diaz | 52/127.11 |
| 4,396,814 | A | | 8/1983 | Miller | |
| 4,772,216 | A | * | 9/1988 | Szymanek | 439/234 |
| 4,785,143 | A | | 11/1988 | Miller | |
| 4,908,483 | A | | 3/1990 | Miller | |
| 4,954,673 | A | | 9/1990 | Miller | |
| 4,972,054 | A | | 11/1990 | Miller et al. | |
| 5,023,411 | A | | 6/1991 | Miller et al. | |
| 5,027,552 | A | | 7/1991 | Miller et al. | |
| 5,079,417 | A | * | 1/1992 | Strand | 250/221 |
| 5,087,799 | A | | 2/1992 | Pariot et al. | |
| 5,144,780 | A | * | 9/1992 | Gieling et al. | 52/298 |
| 5,225,640 | A | | 7/1993 | Miller et al. | |
| 5,260,529 | A | | 11/1993 | Miller | |
| 5,297,360 | A | * | 3/1994 | Besore et al. | 49/484.1 |
| 5,345,671 | A | | 9/1994 | Miller | |
| 5,399,851 | A | | 3/1995 | Strand | |
| 5,418,342 | A | * | 5/1995 | Miller | 200/61.43 |
| 5,426,293 | A | | 6/1995 | Miller et al. | |
| 5,438,798 | A | | 8/1995 | Plamper et al. | |
| 5,620,039 | A | * | 4/1997 | Delgado et al. | 160/265 |
| 5,728,984 | A | | 3/1998 | Miller | |
| 5,839,227 | A | * | 11/1998 | Gardner | 49/27 |
| 5,921,028 | A | * | 7/1999 | Marocco | 49/403 |
| 5,962,825 | A | * | 10/1999 | Miller | 200/61.43 |
| 6,178,094 | B1 | * | 1/2001 | Hakozaki | 361/796 |
| 6,199,321 | B1 | * | 3/2001 | Ginzel | 49/27 |
| 6,286,257 | B1 | * | 9/2001 | Gregoriou et al. | 49/27 |
| 6,484,360 | B1 | * | 11/2002 | DeBartolo et al. | 16/95 R |
| 6,571,512 | B1 | * | 6/2003 | Miller et al. | 49/27 |
| 6,600,113 | B1 | | 7/2003 | Miller | |
| 6,651,385 | B2 | * | 11/2003 | Miller et al. | 49/27 |
| 6,683,296 | B2 | * | 1/2004 | Miller et al. | 250/221 |
| 6,723,933 | B2 | * | 4/2004 | Haag et al. | 200/61.42 |
| 6,920,717 | B2 | * | 7/2005 | Miller et al. | 49/27 |
| 7,373,754 | B2 | * | 5/2008 | Albiero | 49/27 |
| 7,525,062 | B2 | * | 4/2009 | Adam et al. | 200/600 |
| 7,603,813 | B2 | * | 10/2009 | Hackl | 49/506 |
| 2005/0001573 | A1 | * | 1/2005 | Miller et al. | 318/445 |
| 2006/0113172 | A1 | | 6/2006 | Sugimori et al. | |
| 2006/0192682 | A1 | | 8/2006 | Miller | |
| 2007/0068787 | A1 | | 3/2007 | Burgess et al. | |
| 2010/0154311 | A1 | | 6/2010 | Condon et al. | |
| 2010/0307065 | A1 | * | 12/2010 | Eckartsberg | 49/475.1 |
| 2011/0158742 | A1 | * | 6/2011 | Lawson | 403/292 |
| 2012/0079898 | A1 | | 4/2012 | Castello et al. | |
| 2012/0081130 | A1 | | 4/2012 | Provenzano et al. | |

FOREIGN PATENT DOCUMENTS

| | | | |
|---|---|---|---|
| DE | 20013310 | U1 | 12/2000 |
| GB | 2323214 | A | 9/1998 |

OTHER PUBLICATIONS

Miller Edge Custom Hangar Door Edges Brochure, 8 pages.
Miller Edge Sensing Edges Brochure, 12 pages.
Office Action issued Jul. 18, 2013 in U.S. Appl. No. 13/247,425.
Office Action issued Oct. 18, 2013 in U.S. Appl. No. 13/252,660 by Provenzano.
Office Action issued Dec. 6, 2013 in U.S. Appl. No. 13/247,425 by Castello.
Office Action issued Mar. 27, 2014 in U.S. Appl. No. 13/252,660 by Provenzano.
Extended European Search Report issued Jun. 25, 2014 in EP Application No. 11183864.5.
Extended European Search Report issued Jun. 25, 2014 in EP Application No. 11183873.6.

* cited by examiner

SENSING EDGE

CROSS-REFERENCE TO RELATED APPLICATIONS

This application is a divisional of co-pending U.S. application Ser. No. 13/247,425, filed Sep. 28, 2011, entitled "Sensing Edge," which claims priority to U.S. Provisional Patent Application No. 61/389,867, filed Oct. 5, 2010, entitled "Sensing Edge with T-Bar End Flap," the contents of both of which are herein incorporated by reference in their entireties.

BACKGROUND OF THE INVENTION

Preferred embodiments of the present invention relate to end flaps for use with sensing edges for automatic doors or the like. Sensing edges for automatic doors are generally known. A description of a sensing edge can be found, for example, in U.S. Pat. No. 6,571,512, titled "Universal Sensing Edge with Non-Melt End Closure," and which disclosure is incorporated by reference herein in its entirety.

Sensing edges generally include an elongated sheath configured to sense force. Upon an application of a force to the sheath, the elongated sheath actuates suitable control circuitry for controlling movement of a door. For example, an automatic door can have a sensing edge on a bottom edge. If an object is below the elongated sheath, the elongated sheath is pressured by the object when the automatic door impacts the object when closing. Such force is "sensed" by the elongated sheath, which results in a predetermined signal being sent to a mechanism which opens or closes the automatic door to cause the automatic door to stop moving to prevent damage to the object or the door.

In certain installations, a space remains between the sensing edge and a wall or other structure adjacent to the automatic door. The space can be a source of light or a path through which rodents or other animals may enter past the edge of the automatic door. In addition, snow, rain, leaves or other objects may enter the structure associated with the door, even when the door is closed. Accordingly, it is desirable to design and construct a sensing edge for a door that blocks the space to impede the aforementioned lights, rodents, debris or other objects from moving through the space past the door when the door is closed.

BRIEF SUMMARY OF THE INVENTION

Briefly stated, a preferred embodiment of the present application is directed to a sensing edge for providing a signal to a controller indicating that a forward edge of a door is obstructed during operation. The sensing edge includes an elongate sheath, a first end plug and a first end flap. The elongate sheath has a first end and a second end. A first cavity is located at the first end. The elongate sheath is mounted to the forward edge. The first end plug includes an inner end, an outer end, first engaging structures extending from the inner end and a first vertical groove in the outer end. The engaging structures are positioned within the first cavity in an assembled configuration. The first end flap includes a relatively flat first body and a first flange structure. The first flange structure is positioned in the first vertical groove in the assembled configuration to secure the first end flap to the first end plug.

In another aspect, a preferred embodiment of the present invention is directed to an end assembly for a sensing edge for providing a signal to a controller indicating that a forward edge of a door is obstructed during operation. The end assembly includes a first end plug and a first end flap. The first end plug has an inner end, an outer end, first engaging structures extending from the inner end, a first vertical groove in the outer end and a horizontal groove in the outer end. The outer end defines an outer plane. The first end flap includes a first body and a first flange structure. The first body is positioned on a first side of the outer plane and the first flange structure is positioned on an opposite second side of the outer plane in an assembled configuration.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
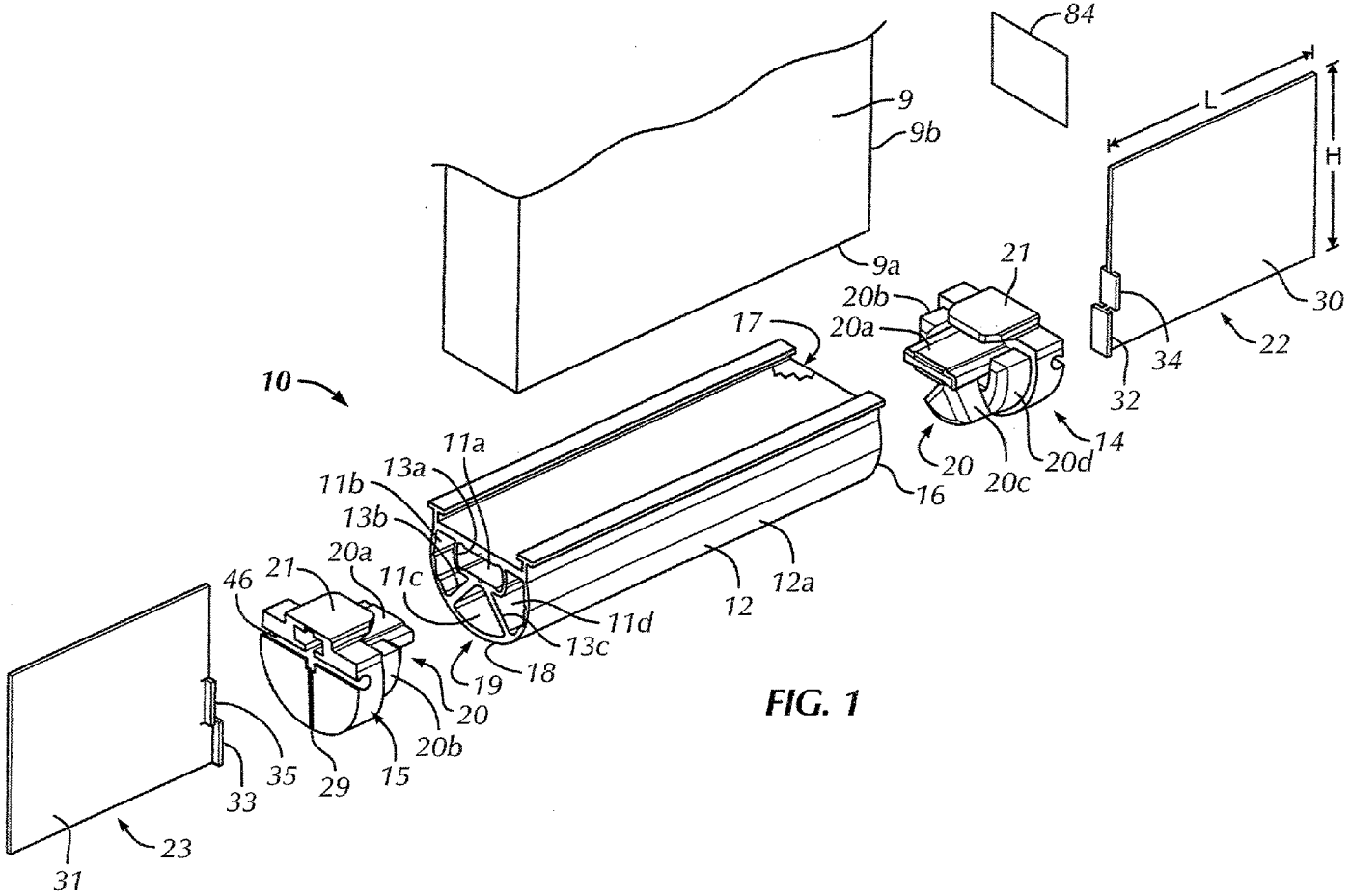
FIG. 1 is a right-side perspective, partially exploded fragmentary view of a sensing edge in accordance with a first preferred embodiment of the present application and an automatic door.

Certain terminology is used in the following description for convenience only and is not limiting. The words "right," "left," "lower," and "upper" designate directions in the drawings to which reference is made. The words "inwardly," "inner," "distally," "outer," "outwardly," or "proximally" refer to directions toward and away from, respectively, the geometric center or orientation of the device and related parts thereof. The terminology includes the above-listed words, derivatives thereof and words of similar import.

Referring to FIGS. 1-4, a sensing edge 10 in accordance with a first preferred embodiment of the present application includes an elongated sheath 12, a first end plug 14, and a first end flap 22. The sensing edge 10 is preferably mounted to a door, gate or other structure 9 that opens and/or closes upon actuation by a user. The door 9 is typically driven to open or close by a driving motor (not shown) upon remote actuation by the user. The door 9 may be comprised of a garage door 9, a gate 9 or nearly any door or structure that opens and/or closes based upon actuation by the user. The sensing edge 10 is preferably mounted to the door 9 to provide a signal to a controller 100 indicating that an edge, preferably a forward edge 9*a* of the door 9 is obstructed during operation. The sensing edge 10 preferably prevents the door 9 from damaging an object that obstructs the opening and/or closing path of the door 9 by sensing the object when the sensing edge 10 comes into contact with the object during use. Accordingly, the sensing edge 10 is preferably mounted to an edge 9*a* of the door 9 that may come into contact with an object during opening and/or closing. For example, the sensing edge 10 may be mounted to the bottom or forward edge 9*a* of a garage door 9 such that the sensing edge 10 comes into contact with objects or people that may obstruct the opening and/or closing of the door 9, as would be understood by one having ordinary skill in the art. The sensing edge 10 is not limited to being mounted to the bottom or forward edge of the door 9 and may be mounted to a side edge of the door 9, particularly for a door 9 that opens or closes by travelling laterally on a track (not shown), as opposed to a traditional garage door 9 that generally opens and closes along a generally vertical path. Accordingly, the sensing edge 10 is preferably mounted to the door 9 along an edge where it may come into contact with an object during the opening and/or closing operations, which may be described as the forward edge 9*a* of the door 9.

The elongated sheath 12 of the sensing edge 10 of the first preferred embodiment has a first end 16 and a second end 18. The first end plug 14 is positioned to engage and close the first end 16. Preferably, engaging structures 20 on the first end plug 14 are inserted into the elongated sheath 12 at the first end 16 to frictionally engage the elongated sheath 12 and permit the first end plug 14 to close the first end 16. The first end flap 22 is preferably slidingly engaged with the first end plug 14. An adhesive or other fastening device may also be used to secure the first end plug 14 to the elongated sheath 12.

The first end flap 22 preferably has a substantially rectangular shape, with one or more corners optionally having rounded shapes. The length of the elongated sheath 12 is not drawn to scale in FIG. 1, and is of a length appropriate for attachment to the entire length of the door 9 onto which the sensing edge 10 will be attached. A second end plug 15 is also utilized to close the second end 18 and is positioned in similar fashion as the first end plug 14 in the mounted or assembled configuration. The first end 16 is configured for engagement with the first end plug 14 and is preferably configured to receive the engaging structures 20. The second end 18 is likewise configured for engagement with the second end plug 15 and is preferably configured to receive engaging structures of the second end plug 15 in the mounted or assembled configuration. The first end plug 14 and the second end plug 15 may be the same or different, depending upon the design and/or configuration of the sensing edge 10. The first and second ends 16, 18 can likewise be the same or different, depending upon design of the sensing edge 10.

The first end flap 22, first end plug 14, and elongated sheath 12 are preferably constructed of a flexible material, such as rubber or the like. The first end flap 22, elongated sheath 12, and first end plug 14 are configured such that when the elongated sheath 12 is attached to the bottom, forward or leading edge of the automatic door 9, the first end flap 22 is positioned in a space between the first end plug 14 and a wall or other structure (not shown) adjacent to the side of the automatic door 9, in order to block light and/or animals from entering around the door 9. The first end flap 22 includes a first body or flat portion 30, which is preferably comprised of a thin, planar structure. The first end flap 22 preferably defines a plane which is substantially parallel to a plane defined by the automatic door 9 when the sensing edge 10 is attached to the automatic door 9. This way, the first end flap 22 blocks the space adjacent to the first end plug 14 to block light and animals or other objects or substances from entry. Typically, the automatic door 9 is substantially vertical, and the first body 30 extends substantially vertically as well.

Figure 2:
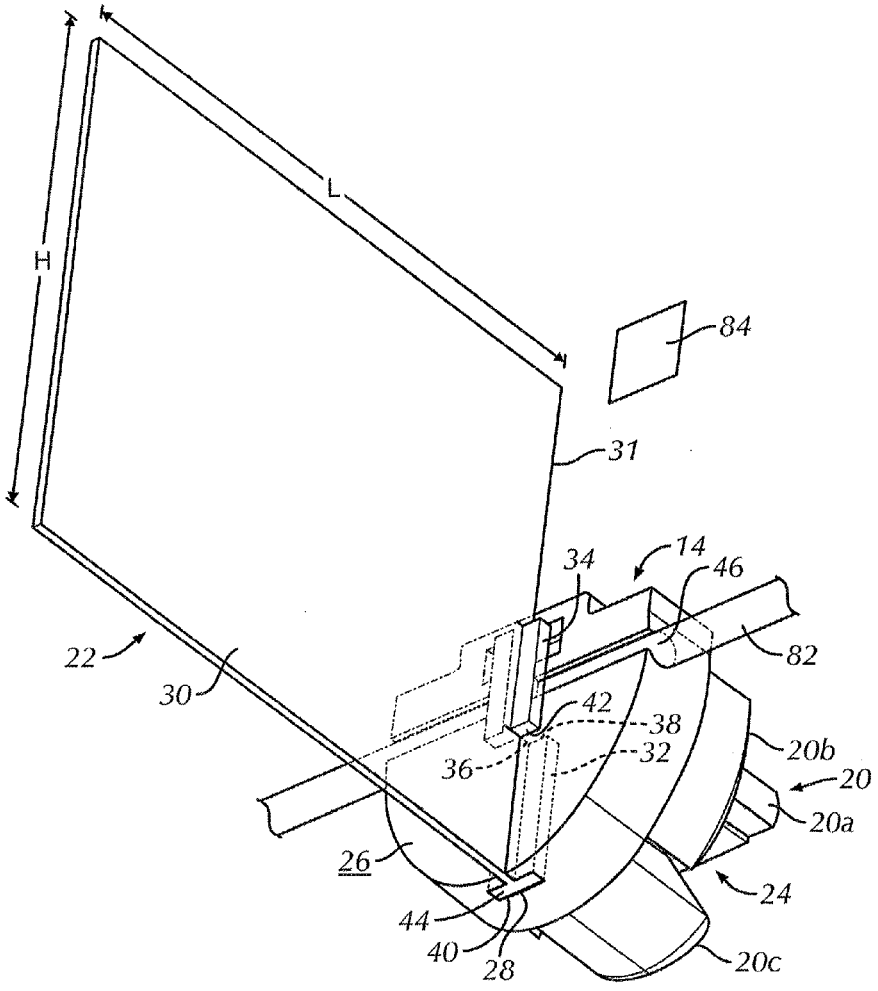
FIG. 2 is a front perspective view of an end cap and an end flap of the sensing edge of FIG. 1.

Referring to FIG. 2, the first end plug 14 of the first preferred embodiment includes an inner or first end 24 which includes the first engaging structures 20, and an outer or second end 26 which is configured to engage the first end flap 22. The first end plug 14 includes a first vertical groove 28 in the outer end 26 designed to engage a portion of the first end flap 22 in order to attach the first end flap 22 to the first end plug 14. The first vertical groove 28 preferably has a T-shape, but is not so limited and may have nearly any shape that is able to engage the first end flap 22 to secure the first end flap 22 to the first end plug 14. For example, the first vertical groove 28 may be comprised of a planar section of the outer end 26 upon which the first end flap 22 is adhesively bonded, staked or otherwise secured to the first end plug 14. In the first preferred embodiment, the first vertical groove 28 is an elongated groove having a T-shaped cross-section.

The first end flap 22 includes the first body 30, a first flange structure 32 and, preferably, a second flange structure 34. The first and second flange structures 32, 34 are located at a first edge 31 of the first end flap 22 which faces the outer end 26 of the first end plug 14 when engaged therewith. The first and second flange structures 32, 34 preferably define T-shapes (i.e., "T" cross-sectional shapes) along with the first body 30 and extend laterally beyond the front and back surfaces of the first body 30. The first flange structure 32 is preferably located on a step portion 36 of the first end flap 22. When in use, the vertical T-shaped groove 28 of the first end plug 14 typically extends longitudinally in a substantially vertical direction and the first end flap 22 extends in a substantially vertical direction in the assembled configuration.

In order to engage the first end flap 22 with the first end plug 14 of the first preferred embodiment, the first flange structure 32 slides into the vertical T-shaped groove 28 from below as shown in FIG. 2. This is done by inserting a first end 38 of the first flange structure 32 into a lateral opening 40 at a lower surface of the first end plug 14 into the vertical T-shaped groove 28 and sliding the first flange structure 32 upwards into the vertical T-shaped groove 28 until the first end 38 is stopped by a wall structure 42. The wall structure 42 defines an end of the vertical groove 28 in the first preferred embodiment. The first flange structure 32 is preferably secured in the vertical T-shaped groove 28 with preferably little or no extension of a second end 44 of the first flange structure 32 outside of the vertical T-shaped groove 28. This is accomplished by configuring the first flange structure 32 to have substantially the same length as the T-shaped groove 28.

The step portion 36 is preferably dimensioned such that the second flange structure 34 clears the wall structure 42 and faces or is in facing engagement with the outer end 26 of the first end plug 14. The second flange structure 34 is preferably configured and dimensioned to maintain the end flap 22 in a position substantially perpendicular to the outer end 26, by serving as support for the first end flap 22 against the outer end 26. While the first end flap 22 may be secured to the first end plug 14 by engagement between the first flange structure 32 and the vertical T-shaped groove 28, other securing systems are envisioned. For example, the first flange structure 32 can have a different cross-sectional shape, such as circular, square, triangular, etc., with the vertical T-shaped groove 28 having a different cross-sectional shape to accommodate the first flange structure 32. Also, the first end flap 22 may be secured to the first end plug 14 by other ways known in the art, such as by the use of adhesives, such as contact adhesives or pressure-sensitive adhesives. Preferably, the vertical T-shaped groove 28 is positioned at a position which approximately bisects the outer end 26.

Figure 3:
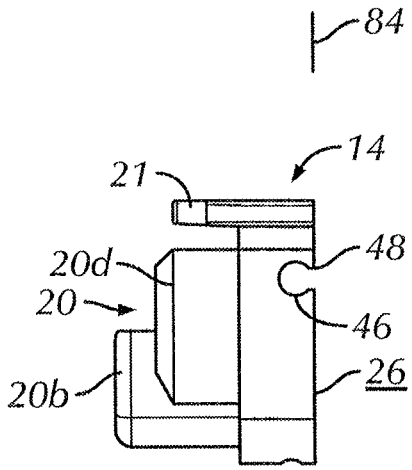
FIG. 3 is a right-side elevational view of the end cap of FIG. 1.
Figure 4:
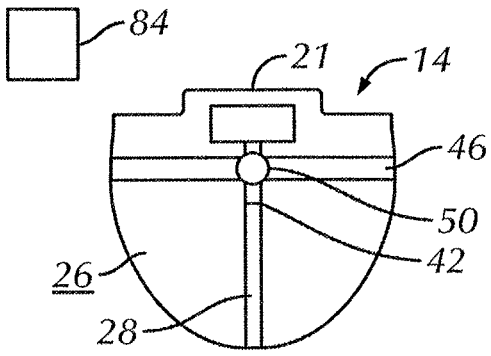
FIG. 4 is a front elevational view of the end cap of FIG. 1.

Referring to FIGS. 3 and 4, the end plug 14 preferably includes a horizontal groove 46 formed substantially perpendicular to a direction defined by the length of the vertical T-shaped groove 28. The horizontal groove 46 has a C-shaped cross-section in the first preferred embodiment such that it is open along the outer end 26. Such a shape allows an electric wire or cable 82 (FIG. 2), especially a sheathed cable, to be secured inside the circular groove 46. The electric wire 82 is generally cylindrical in shape and relatively flexible along its length. The electrical wire 82 is preferably mounted in the horizontal groove 46 by pushing the electric wire 82 laterally through the opening 48 of the horizontal groove 46 with sufficient force to elastically deform the opening 48 and/or wire 82 to permit the wire 82 to be inserted into the circular groove 46. When the electrical wire 82 is fully positioned in the horizontal groove 46, the wire 82 and opening 48 preferably return to their original shapes. The horizontal groove 46 is preferably positioned on an opposite side of the wall structure 42 as the vertical groove 28, such that the first flange structure 32 is not positioned inside the circular groove 46. The electrical wire 82 provides power and/or carries electrical signals to the components of the sensing edge 10 that sense impact of the elongated sheath 10 with objects in the path of travel of the door 9. Securing the electrical wire 82 in the horizontal groove 46 generally fastens the electrical wire 82 relative to the door 9 to limit damage to the electrical wire 82 during use.

The first end plug 14 also includes a passage 50 (FIG. 4), which extends into the first end plug 14 to permit the electrical wire 82 to extend into the first end plug 14. The electrical wire 82 can be, for example, used to connect sensors (not shown) in the elongated sheath 12 with the control mechanism (not shown) of the automatic door 9, in order to send signals to the control mechanism generated as a result of force being applied to the elongated sheath 12. The electrical wire 82 preferably extend from the passage 50 and is diverted to the circular groove 46 in a direction away from the passage 50. Preferably, the passage 50 is aligned with the horizontal groove 46 to accommodate fastening of the electrical wire 82 relative to the first end plug 14.

The elongated sheath 12 of the first preferred embodiment includes a first cavity 17 at the first end 16 and a second cavity 19 at the second end 18. In the assembled configuration, the engaging structures 20 of the first and second end plugs 14, 15 are mounted in the first and second cavities 17, 19 respectively. Positioning of the engaging structures 20 in the first and second cavities at least partially secures the first and second end plugs 14, 15 to the elongated sheath 12. In the first preferred embodiment, the first and second end plugs 14, 15, first and second cavities 17, 19 and first and second end flaps 22, 23 have substantially the same structure and configuration and are described throughout the application with the understanding that these structures are substantially the same, but are not so limited.

Referring to FIG. 1, in the first preferred embodiment, the second end plug 15 includes a second vertical groove 29, similar to the first vertical groove 28 of the first end plug 14. The second end flap 23 preferably includes a relatively flat or planar second body 31 and a third flange structure 33. The third flange structure 33 is preferably positioned in the second vertical groove 29 in the assembled configuration to secure the second end flap 23 to the second end plug 15. The third flange structure 33 may be interference fit into the second vertical groove 29, may be clamped to the second vertical groove 29, adhesively bonded or otherwise secured in the second vertical groove 29 to secure the second end flap 23 to the second end plug 15 in the assembled configuration. Alternatively, the second end flap 23 may be removably mountable to the second end plug 15 through releasable engagement of the third flange structure 33 with the second vertical groove 29 such that alternate flaps or structures may be engaged with the second end cap 15. The second end flap 23 also preferably includes a fourth flange structure 35 having a T-shaped cross-section similar to the second flange structure 34 of the first end flap 22. The second and fourth flange structures 34, 35 are preferably in at least partial facing engagement with the outer ends 26, 27 of the first and second end plugs 14, 15, respectively, to provide support for the bodies 30, 31 and to generally maintain the orientation of the bodies 30, 31 relative to the first and second end plugs 14, 15. The first and second end flaps 22, 23 are not limited to inclusion of the second and fourth flange structures 34, 35 and may be configured without the second and fourth flange structures 34, 35, respectively. The second and fourth flange structures 34, 35 may be adhesively bonded, clamped, staked, secured or otherwise mounted to the outer ends 26, 27 to support the bodies 30, 31 or may be completely excluded from the structure of the first and second end flaps 22, 23, depending upon user preferences.

In the first preferred embodiment, the elongated sheath 12 is relatively hollow between the first and second ends 16, 18. The elongated sheath 12 is not limited to being hollow between the first and second ends 16, 18 and may be relatively solid or may have a variety of structures between the first and second ends 16, 18 depending upon design considerations of the preferred sensing edge 10. The elongated sheath 12 of the first preferred embodiments includes an outer wall 12*a* and first, second and third ribs 13*a*, 13*b*, 13*c* extending from the first end 16 to the second end 18. The outer wall 12*a* and first, second and third ribs 13*a*, 13*b*, 13*c* define first, second, third and fourth voids 11*a*, 11*b*, 11*c*, 11*d* at least at the first and second ends 16, 18. The first, second and third ribs 13*a*, 13*b*, 13*c* provide a stiffness to the elongated sheath 12 to retain the general shape of the sheath 12 and to transmit forces to sensors (not shown) associated with the sheath 12. The first, second and third ribs 13*a*, 13*b*, 13*c* are preferably co-molded or co-extruded with the outer wall 12*a* to form the sheath 12. The sheath 12 is not limited to inclusion of the outer wall 12*a* and first, second and third ribs 13*a*, 13*b*, 13*c* and may be otherwise constructed. For example, the elongated sheath 12 may be constructed without inclusion of the first, second and third ribs 13*a*, 13*b*, 13*c* such that the elongated sheath 12 is hollow between the first and second ends 16, 18 and the outer wall 12*a* defines a single void (not shown) therein. However, the first, second and third ribs 13*a*, 13*b*, 13*c* are preferred to provide strength and stiffness to the elongated sheath 12 to assist in retaining the preferred shape of the sheath 12 and to transmit forces to sensors within the sheath 12 when the sheath 12 impacts an object during opening or closing of the door 9.

In the first preferred embodiment, the engaging structures 20 of the first and second end plugs 14, 15 are generally identical and are described as such herein. However, the engaging structures 20 of the first and second end plugs 14, 15 are not necessarily identical and may be designed and configured based upon user preferences for mounting to the first and second ends 16, 18 and/or for connecting or engaging sensors (not shown) related to the sensing edge 10. The first engaging structures 20 of the first preferred embodiment include a first projection 20*a*, a second projection 20*b*, a third projection 20*c* and a fourth projection 20*d*. The first projection 20*a* is positioned within the first void 11*a*, the second projection 20*b* is positioned within the second void 11*b*, the third projection 20*c* is positioned within the third void 11*c* and the fourth projection 20*d* is positioned within the fourth void 11*d* in the assembled configuration. The first, second, third and fourth projections 20*a*, 20*b*, 20*c*, 20*d* are preferably sized and configured for force-fitting into the first, second, third and fourth voids 11*a*, 11*b*, 11*c*, 11*d*, respectively, in the assembled configuration. The first, second, third and fourth projections 20*a*, 20*b*, 20*c*, 20*d* are not limited to being force-fit into the first, second, third and fourth voids 11*a*, 11*b*, 11*c*, 11*d* and may be otherwise sized and configured such that the first and second end plugs 14, 15 are mounted to the first and second ends 16, 18 when the projections 20*a*, 20*b*, 20*c*, 20*d* engage the voids 11*a*, 11*b*, 11*c*, 11*d*. The projections 20*a*, 20*b*, 20*c*, 20*d* may be maintained in the voids 11*a*, 11*b*, 11*c*, 11*d* by the force fit or may also be secondarily engaged with the elongated sheath 12 by fastening, adhesively bonding or otherwise securing the first and second end plugs 14, 16 to the first and second ends 16, 18. The engagement structure 20 is not limited to inclusion of the projections 20*a*, 20*b*, 20*c*, 20*d*, as described and shown in the figures and the sheath 12 is not limited to inclusion of the voids 11*a*, 11*b*, 11*c*, 11*d* as described and shown in the figures. The engagement structures 20 and elongated sheath 12 and may be alternatively configured for securing the first and second end plugs 14, 15 to the sheath 12, as will be partially described in more detail below in the second and third embodiments.

The engaging structures 20 of the first and second end plugs 14, 16 also preferably include a top projection 21 that does not extend into any of the voids 11*a*, 11*b*, 11*c*, 11*d* of the elongated sheath 12 in the assembled configuration. The top projection 21 extends above the first void 11*a* to create consistent contact between the outer wall 12*a* and the first projection 20*a*. In the first preferred embodiment, the first projection 20*a* is a conductive component that transmits signals to and from the controller 100 along with the outer wall 12*a*. Accordingly, consistent contact between the outer wall 12*a* and the first projection 20*a* is preferred to facilitate transmission of the signals between the first projection 20*a* and the outer wall 12*a*. The top projection 21 maintains this contact between the outer wall 12*a* and the first projection 20*a* by preventing the outer wall 12*a* from buckling or ballooning away from the first projection 20*a* in the assembled configuration. The first and second end plugs 14, 15 are not limited to inclusion of the top projection 21 as shown in the first preferred embodiment and may function without the top projection 21 or may include a projection that is otherwise configured for maintaining contact between the outer wall 12*a* and the first projection 20*a*.

Referring to FIGS. 1 and 2, the first body 30 of the first end flap 22 has a body length L and a body height H. The body length L is at least approximately two inches (2") and the body height H is at least approximately one and one-half inches (1½"). The first end flap 22 is not limited to the described dimensions for the body height H and body length L and may be configured in nearly any manner and to have nearly any size to block an opening between the first end plug 14 and the wall or structure (not shown) adjacent the door 9 to limit light, wind, air, animals or other objects from moving into the structure through the opening or hole between the door 9 in a wall. In addition, the body 30 of the first end flap 22 may be manipulated by the end user to have nearly any size or shape as a result of its relatively flat, thin construction of rubber-like material. For example, the user may cut or shape the body 30 for optimum positioning in blocking the hole.

Referring to FIG. 2, in the first preferred embodiment, the electrical wire 82 is connected to the controller 100 that receives a signal from sensors (not shown) associated with the sensing edge 10. The sensors preferably indicate when the forward edge 9*a* of the door 9 is obstructed during operation. The controller 100 may be mounted separately from the sensing edge 10 or may be mounted on or in components of the sensing edge 10 of the first preferred embodiment. For example, the controller 100 may be mounted within the first or second end plugs 14, 15 for receiving signals from the sensors and directing and controlling operation of the door 9. The electrical wire 82 preferably provides power to the controller 100 and carries signals from the sensor to the controller 100 as well as to the motor (not shown) that drives movement of the door 9. The controller 100 may control various functionality of the door 9, but at least receives signals from the sensors to prevent the door 9 or an object that is impacted by the sensing edge 12 during opening or closing of the door 9 from being damaged.

In the first preferred embodiment, the outer end 26 of the first end plug 14 defines an outer plane 84. The outer end 26 has a relatively flat face that defines the outer plane 84. In the assembled configuration, the body 30 is positioned on one side of the outer plane 84 and the first flange structure 32 is positioned on the opposite side of the outer plane 84. Accordingly, the first flange structure 32 is positioned within the first vertical groove 28 such that the first flange structure 32 is positioned on one side of the outer plane 84 or below the outer end 26 while the first body 30 is positioned on the opposite side of the outer plane 84 and extends from the outer end 26 away from the elongated sheath 12 to bock the hole proximate the edge of the first end plug 14. The first body 30 is preferably oriented generally perpendicularly to the outer plane 84 in the assembled configuration. In addition, the passage 50 generally extends into the first end plug 14 relatively perpendicular to the outer plane 84 and the outer end 26 to accommodate the electrical wire 82.

Figure 5:
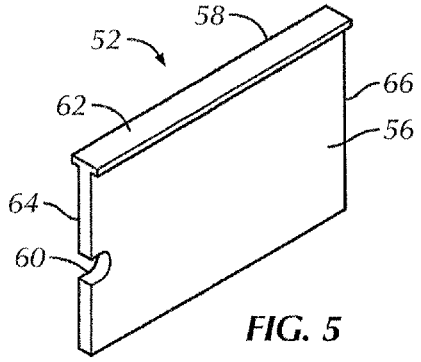
FIG. 5 is a rear perspective view of an end flap of a sensing edge in accordance with a second preferred embodiment of the present application.
Figure 6:
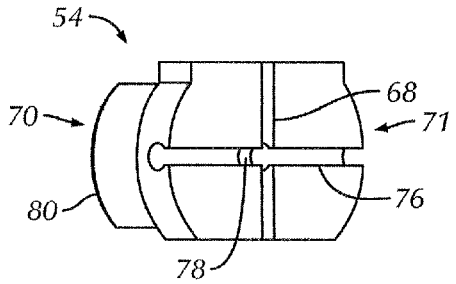
FIG. 6 is a front perspective view of an end cap of a sensing edge in accordance with the second preferred embodiment of the present application.
Figure 7:
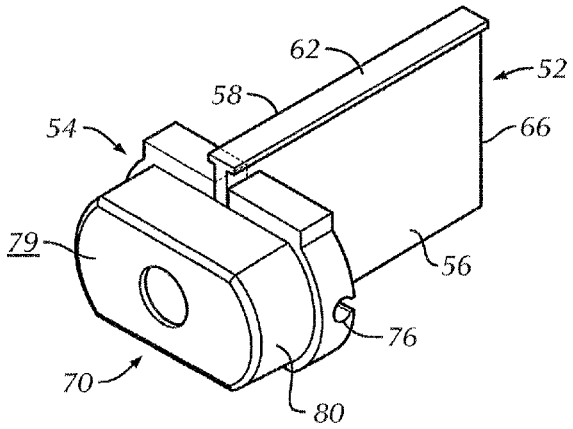
FIG. 7 is a rear perspective view of the end flap and end cap of FIGS. 5 and 6 in an assembled configuration.

Referring to FIGS. 5-7, in a second preferred embodiment, the sensing edge 10 has an alternatively configured first end plug 54 and first end flap 52. However, the generally function and operation of the first end plug 54 and first end flap 52 of the second preferred embodiment of the sensing edge 10 are substantially similar to the function and operation of the first end plug 14 and first end flap 22 of the first preferred embodiment, particularly in that the first end plug 54 and first end flap 52 are mounted to the elongated sheath 12 in the assembled configuration.

In the second preferred embodiment, the first end flap 52 includes a flat portion or body 56, a top flange structure 58, and notch 60. The first end flap 52 of the second preferred embodiment is substantially rectangular in shape, with the top flange structure 58 formed as a first or top edge 62 of the first end flap 52. The first end flap 52 of the second preferred embodiment does not include the first and/or second flange structures 32, 34 of the first preferred embodiment, but is not so limited and may include the first and/or second flange structures 32, 34 of the first preferred embodiment to secure the first end flap 52 to the first end plug 54 and stabilize the first end flap 52 relative to the first end plug 54, respectively. The first or top edge 62 including the top flange 58 of the second preferred embodiment is longer than second and third edges 64, 66. The top flange structure 58 extends beyond the planar surfaces of the body 56 to provide stiffness to the body 56 and to properly position the body 56 relative to the first end plug 54 in the assembled configuration by engaging the top of the first end plug 54 in the assembled configuration.

The vertical groove 68 of the first end plug 54 of the second preferred embodiment extends along the entire height of the outer end 71. The vertical groove 68 is configured to receive the second edge or first flange structure 64 of the first end flap 52, in order for the first end plug 54 and the first end flap 52 to engage one another. The second edge or first flange structure 64 of the second preferred embodiment has a generally rectangular cross-section that is engaged by the generally rectangular-shaped vertical groove 68 of the second preferred embodiment. Preferably, the second edge or first flange structure 64 of the first end flap 52 is inserted into the vertical groove 68 until movement stops when the top flange structure 58 abuts the upper end of the first end plug 54 in the assembled configuration (see FIG. 7). The vertical groove 68 preferably approximately bisects the outer end 71.

The first end plug 54 also includes the horizontal groove 76, which is substantially perpendicular to the vertical groove 68 and intersects the vertical groove 68, generally at a center of the outer end 71 and at a middle of the vertical groove 68. The horizontal groove 76 preferably has a C-shaped cross-sectional shape, similar to the horizontal groove 46 of the first preferred embodiment. The position of the vertical groove 68 is similarly configured to the vertical groove 28 of the first preferred embodiment such that, in use, the first end flap 52 defines a plane substantially parallel to a plane defined by the automatic door 9. Accordingly, when the door 9 is closed, the first end flap 52 blocks light, animals and other objects from entering past the automatic door 9, as explained above. The orientation of the vertical and horizontal grooves 68, 76 is similar to the orientation of the vertical groove 28 and the horizontal groove 46 of the first preferred embodiment. The orientation of the body 56 of the second preferred embodiment is relatively the same as the orientation of the body 30 of the first preferred embodiment in the assembled configuration.

In the second preferred embodiment, a passage 78 is defined at the intersection of the vertical and horizontal grooves 68, 76. The passage 78 is similar to the passage 50 of the first embodiment described above in orientation and function. A notch 60 is formed in the first end flap 52 of the second preferred embodiment such that when the first end flap 52 and the first end plug 54 engage one another, the notch 60 overlaps the passage 78 to avoid blocking the horizontal groove 76 with the first end flap 52. The notch 60 provides space for passage of a sheathed wire (not shown), which is similar to the electrical wire 82 of the first preferred embodiment, to come through the passage 78, bend within the notch 60 and extend along the horizontal groove 76 away from the passage 78. The electrical wire of the second preferred embodiment similarly provides power or a path for sending electrical signals to a controller from the sensing edge 10 of the second preferred embodiment.

The first end plug 54 has a first engaging structure 80 on an inner end 70 that is designed for insertion into the elongated sheath 12. The first engaging structure 80 of the second preferred embodiment is generally solid for insertion into a single void in the elongated sheath 12, as opposed to the multiple projections 20*a*, 20*b*, 20*c*, 20*d* of the engaging structure 20 of the first preferred embodiment. The materials for the first end plug 54 and the first end flap 52 are preferably the same in the second preferred embodiment as for the first end plug 14 and the first end flap 22 of the first preferred embodiment, but are not so limited. The elongated sheath 12 of the second preferred embodiment is similar to the elongated sheath 12 of the first embodiment, with the hollow portion of the elongated sheath 12 of the second preferred embodiment comprising a generally open void without the ribs 13*a*, 13*b*, 13*c* of the first preferred embodiment, at least proximate the first and second ends 16, 18. The first engaging structure 80 of the second preferred embodiment is not limited to being constructed as a solid plug and may be configured the same or similarly to the engaging structure 20 of the first preferred embodiment, as will be understood by one having ordinary skill in the art. However, the solid first engaging structure 80 of the second preferred embodiment is different from first engaging structure 20 of the first preferred embodiment and requires a different elongated sheath 12, at least in the hollow portion proximate the first and second ends 16, 18. The engaging structure 80 of the first end plug 54 of the second preferred embodiment preferably includes an inner face 79. The first and second cavities 17, 19 of the elongated sheath 12 are preferably generally open at least outwardly of where the inner face 79 is positioned in the assembled configuration and the elongated sheath 12 may include the first, second and third ribs 13*a*, 13*b*, 13*c* along the remainder of the length of the elongated sheath 12 or may be otherwise configured, depending upon design considerations. The first end plug 54 is preferably secured to the elongated sheath 12 by a force fit between the engagement structure 80 and the outer wall 12*a* of the elongated sheath at the first end 16, but is not so limited, as was similarly described above with respect to the engagement structures 20 of the first preferred embodiment.

Figure 8:
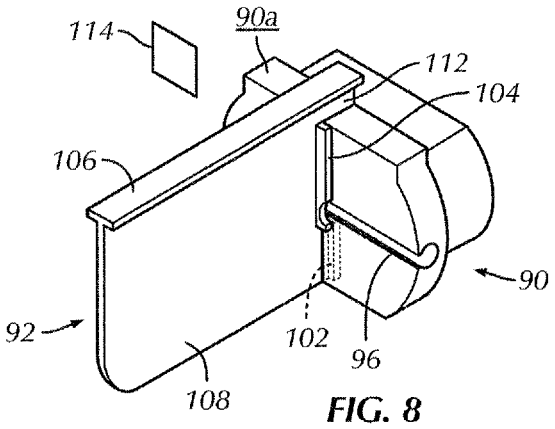
FIG. 8 is a front perspective view of an end flap and an end cap in accordance with a third preferred embodiment of the present application in an assembled configuration.
Figure 9:
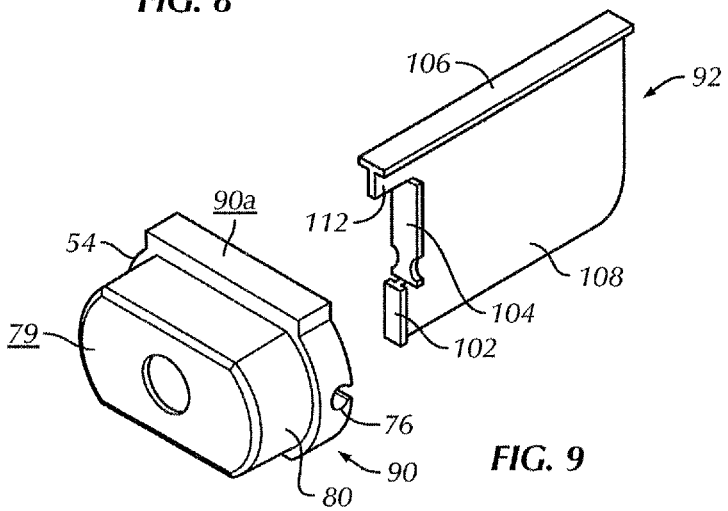
FIG. 9 is a rear perspective, partially exploded view of the end cap and end flap of FIG. 8.
Figure 10:
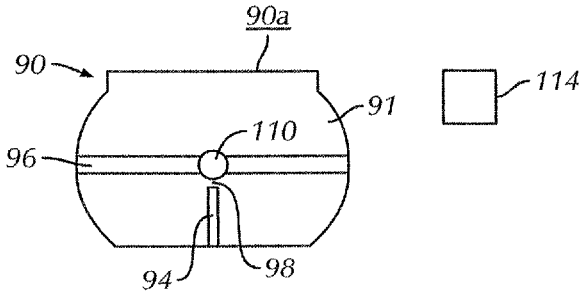
FIG. 10 is a front elevational view of the end cap of FIG. 8.

Referring to FIGS. 8-10, a first end plug 90 and a first end flap 92 of a third preferred embodiment having similar constructions and functions with respect to the first end plugs 14, 54 and first end flaps 22, 52 of the first and second preferred embodiments. Features of the first end plug 90 and first end flap 92 of the third preferred embodiment are described herein, while other features are not specifically described, but are generally similar to the construction and operation of related features of the first end plugs 14, 54 and first end flaps 22, 52 of the first and second preferred embodiments. The first end first end plug 90 and first end flap 92 of the third preferred embodiment are configured for mounting to the first and second ends 16, 18 of the elongated sheath 12 to define the sensing edge 10 of the third preferred embodiment.

The first end plug 90 includes a vertical groove 94, a horizontal groove 96, an outer end 91 and a wall structure 98 similar to the construction of the first end plug 14 of the first preferred embodiment. The vertical groove 94 of the third preferred embodiment has a generally T-shaped cross section and a passage 110 is defined at the intersection of the horizontal groove 96 and extension of the vertical groove 94 beyond the wall structure 98 for accommodating the electrical wire 82. The first end flap 92 of the third preferred embodiment includes a first flange structure 102, a second flange structure 104, a top flange structure 106 and a body 108 similar to the like features of the first and second end flaps 22, 52 of the first and second preferred embodiments. The first flange structure 102 has a generally T-shaped cross section that is positioned within the vertical groove 94 in the assembled configuration of the third preferred embodiment and the second flange structure 104 is in generally close proximity or facing engagement with the outer end 91 in the assembled configuration.

The first end flap 92 of the third preferred embodiment also includes an overhang 112 position adjacent a top end of the second flange structure 104. The overhang 112 is positioned between the top flange structure 106 and the second flange structure 104. In the assembled configuration, the overhang 112 is adjacent to or in facing engagement with an upper surface 90*a* of the first end plug 90. The overhang 112 is also positioned on the same side of an outer plane 114 defined by the outer end 91 of the first end plug 90 as the first flange structure 102, while the second flange structure 104 and body 108 are preferably positioned on an opposite side of the outer plane 114 in the assembled configuration. The overhang 112 provides additional stability to the first end flap 92 relative to the first end plug 90 in the assembled configuration. Specifically, the stiffness provided by the first and second flange structures 102, 104 and the top flange structure 106 in combination with engagement between the first flange structure 102 and vertical groove 94, second flange structure 104 and outer end 91 and overhang 112 with the upper surface 90*a* provides additional strength and stiffness when the first end flap 92 is engaged with the first end plug 90 in the assembled configuration. To provide further strength and stiffness, the overhang 112 may be secured, fastened, adhesively bonded or otherwise fixedly mounted to the upper surface 90*a*, but is not so limited. For example, the first end flap 92 may be removably mounted to the first end plug 90 such that the first end flap 92 may be removed and replaced when it becomes worn or a revised first end flap 92 having an alternative shape or configuration is desired.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A sensing edge for providing a signal to a controller indicating that a forward edge of a door is obstructed during operation, the sensing edge comprising:

an elongate sheath having a first end, a first cavity at the first end, and a second end, the elongate sheath being mounted to the forward edge;

a first end plug including an inner end, an outer end, first engaging structures extending from the inner end and positioned within the first cavity in an assembled configuration, and a first vertical groove in the outer end, extending from an upper surface to a lower surface of the first end plug, and a first end flap including a generally flat first body, a top flange structure forming a T-shape with the first body, and an edge of the first body having a generally rectangular cross-section and a notch formed therein, the edge being positioned in the first vertical groove in the assembled configuration to secure the first end flap to the first end plug.

2. The sensing edge of claim 1, wherein the first end plug further includes a horizontal groove extending generally laterally across the outer end and being open along the entire width of the outer end.

3. The sensing edge of claim 2, wherein the first vertical groove is open along the entire height of the outer end, the first vertical groove intersecting with the horizontal groove at an intersection, and the first end plug further includes a passage extending into the first end plug away from the outer end at the intersection.

4. A sensing edge for providing a signal to a controller indicating that a forward edge of a door is obstructed during operation, the sensing edge comprising: an elongate sheath having a first end, a first cavity at the first end, and a second end, the elongate sheath being mounted to the forward edge;

a first end plug having an inner end, an outer end defining an outer plane, first engaging structures extending from the inner end, a first vertical groove in the outer end, extending from a lower surface to an upper surface of the first end plug, and a horizontal groove in the outer end, wherein the first vertical groove intersects the horizontal groove at an intersection, a passage extending generally perpendicularly relative to the outer plane at the intersection; and a first end flap including a first body and a first flange structure, the first body being positioned on a first side of the outer end and the first flange structure being located at an adjacent second side of the outer end in an assembled configuration.

* * * * *